US005453029A

United States Patent [19]

Moldenhauer et al.

[11] Patent Number: 5,453,029

[45] Date of Patent: Sep. 26, 1995

[54] CONTACT SUPPORT FOR A MOLDED CONNECTOR

[75] Inventors: David W. Moldenhauer, Goldsboro; Carl C. Strickland, Jr., Kinston, both of N.C.

[73] Assignee: Cooper Industries, Inc., Houston, Tex.

[21] Appl. No.: 298,871

[22] Filed: Aug. 31, 1994

[51] Int. Cl.[6] ..... H01R 13/504

[52] U.S. Cl. ..... 439/606; 264/266; 264/275; 264/279.1

[58] Field of Search ..... 439/606, 686, 439/695; 264/266, 275, 279.1

[56] References Cited

U.S. PATENT DOCUMENTS 4,043,630 8/1977 Suverison et al. ..... 439/606

5,282,753 2/1994 Su ..... 439/695

*Primary Examiner*—Gary F. Paumen

*Attorney, Agent, or Firm*—Charles E. Neff; William B. Patterson; Eddie E. Scott

[57] ABSTRACT

A molded connector has a contact support made of a material which is chemically compatible with the molded body and has a similar melting point. The contact support is provided with thin fins which provide a barrier around each of the contacts. As the molded material is injected around the contact support and contacts, the fins melt and fuse to the surrounding material, thereby isolating the contacts from each other.

10 Claims, 1 Drawing Sheet

FIG. 1
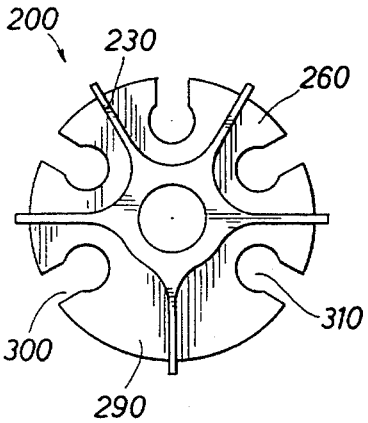
FIG. 2
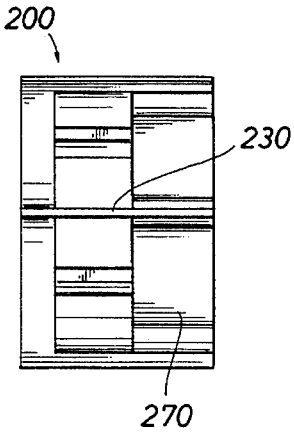
FIG. 3
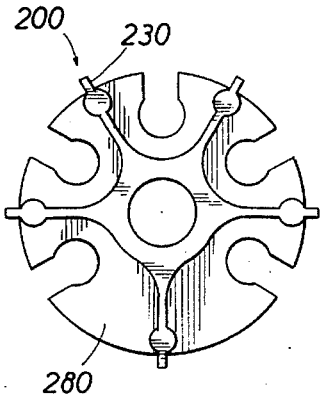
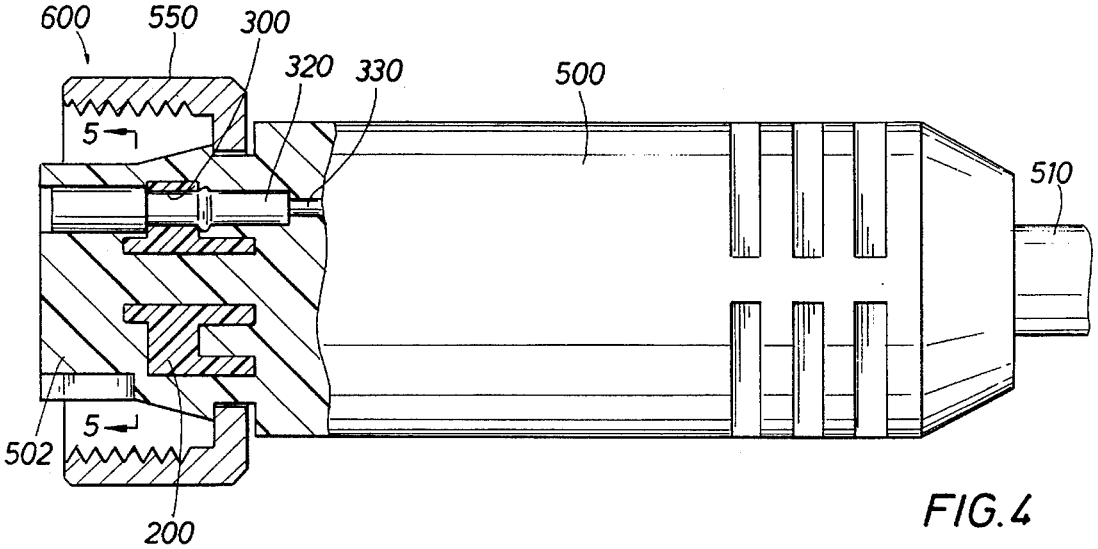
FIG. 4
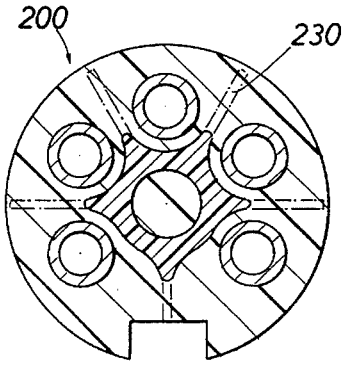
FIG. 5

CONTACT SUPPORT FOR A MOLDED CONNECTOR

BACKGROUND OF INVENTION

The present invention relates to molded electrical connectors; more particularly, the present invention relates to a molded electrical connector with an improved means of insulating contacts from each other thereby avoiding an electrical failure between contacts due to the introduction or intrusion of conductive liquid into the connector.

Molded connectors are typically used to interface sensors and other control components between a source of power and a load. For example, the molded connector may be used to connect a control device, like a proximity switch in series with electrical power lines and a machine. The connector head houses a number of wires which terminate into contacts. The contacts are typically of the female type and mate with male type contacts available with sensors and switches.

Because of harsh environmental conditions, connector heads are often molded around the wires and contacts to seal against dust, moisture and chemicals. To aid in the molding process, a contact support holds the contacts in place while a thermoplastic material is injected around and encapsulates the contact support. In prior art connectors, the contact support is typically made of a dissimilar material that will not melt as the heated material is injected around it. Because the prior art contact supports are of a dissimilar material and do not bond to the molded material during injection, there are often cracks or separations between the contact support and surrounding material thereby allowing liquid to communicate between the contacts. In certain industries like breweries and dairies, connectors are routinely subjected to sprays of liquid which can enter the end of the connector where the contacts are exposed. At other times, because of high humidity, water vapor can travel between the contacts.

There is a need therefore, for a molded connector with an improved means for isolating the contacts from each other.

There is a further need therefore, for a molded connector which prevents water or other conductive liquids from communicating between the contacts and causing an electrical failure between the contacts.

There is yet a further need therefore, for a molded connector with an improved contact support which prevents water or other conductive liquids from moving between the contacts of the connector.

SUMMARY OF INVENTION

A molded connector has a contact support which is made of a material chemically compatible with and having a similar melting point as the molded body material. The support includes access slots which are designed to securely hold cylindrical contacts. The contact support is also provided with thin fins which extend from the front, rear and outer perimeter surfaces. When the head is formed and heated material is injected around the contact support and contacts, the thin fins melt and fuse to the surrounding material thereby isolating the contacts from each other and avoiding cracks or separations. The resulting connector is resistant to sprays of liquids or vapor which might enter from the open face of the connector where the contacts are exposed.

BRIEF DESCRIPTION OF THE FIGURES

FIG. 1 is a front view of the contact support of the present invention;

FIG. 2 is a side view of the contact support of the present invention;

FIG. 3 is a rear view of the contact support of the present invention;

FIG. 4 is a side view, partially in section of the connector head; and

FIG. 5 is a section view depicting the contact support after the connector head has been molded around it.

DESCRIPTION OF AN EMBODIMENT

The connector head of the present invention is best described by reference to the Figures. As shown in FIGS. 1–3, the contact support 200 of the preferred embodiment is disk-shaped with access slots 300 spaced around its perimeter. Each access slot 300 includes a semicircular portion 310 designed to allow a cylindrical contact to be inserted and held in support 200. Extending radially outward from the center 240 of the support 200 are fins 230. The fins 230 extend from the front 260, outer perimeter 270 and rear 280 surfaces of support 200 to create barriers dividing the surfaces of the support 200 into sections 290.

FIG. 4 depicts the molded connector 600 including the contact support 200 of the present invention. Connector 600 includes a molded head 500 which encloses a cord 510 at a first tapered end 501 and encapsulates the contact support 200, contacts 320 and wires 330 at a second end 502. As depicted, each contact 320 is retained in a access slot 300 formed in the contact support 200. Each contact 320 is exposed at the second end 502 of the connector to allow attachment to a load (not shown). A threaded coupler 550 aids in the connection of the connector 600 to the load.

Unlike prior art molded connectors, the contact support 200 of the present invention is formed of the same material as the molded head 500. In an alternative embodiment, the contact support is formed of a second material having a chemical compatibility and similar melting point as the material of the molded head 500. Because the contact support material has the same or similar characteristics as the molded head material, fins 230 will melt during the injection molding of the connector head thereby isolating each contact within a section 290.

When the connector head is formed, the contacts 320 are first crimped onto the wires 330. Thereafter, each contact 230 and wire 330 is inserted into semicircular portion 310 of access slot 300. The contacts are then placed in a block (not shown) which acts as a fixture holding the wire-contact-support assembly in place. The block is then placed in the bottom half of a mold and the top half of the mold is closed before the injection process begins. The heated thermoplastic material is injected into the mold and through a combination of heat and pressure the molded head is formed around the support 200. During the injection process, the fins 230 become molten and fuse with the surrounding thermoplastic material. Each fin 230 is formed with a thickness between 0.13 and 0.23" to ensure melting during the molding process. In the preferred embodiment, the ratio of thickness between the contact support and fins is 7:1. FIG. 5 is a section view showing the contact support 200 after the connector head 500 has been molded around it. Fins 230 have melted and fused to the surrounding material of the head 500 thereby isolating each section 290 and contact 320.

As the forgoing illustrates, the molded connector of the present invention solves the problems associated with electrical failure between contacts in a molded connector. While the molded connector of the present invention has been described by reference to its preferred embodiment, it will be understood that other various embodiments of the device and method of the present invention may be possible by reference to the specification and the appended claims. Such additional embodiments shall be included within the scope of the appended claims. For example, the fins 230 could be shaped any number of ways and still result in an isolating of the contacts so long as they at least partially melt and fuse with the surrounding material during injection molding. Additionally, the contacts could be of the male type as the invention is equally useful with either male or female type contacts. Also, the invention is not limited to use with a connector having a certain number of contacts.

We claim:

1. A molded electrical connector for completing an electrical circuit, said connector comprising:

a head made of a moldable material;

a contact support made of said moldable material, said contact support including means for retaining a plurality of contacts and means for isolating said contacts from each other, said head being molded around said contact support to hold said contacts therein; and a plurality of wires electrically and mechanically connected to said plurality of contacts.

2. The molded connector described in claim 1, wherein said contact support further includes a substantially disk-shaped body having a front surface, rear surface and outer perimeter surface.

3. The molded connector described in claim 2, wherein said means for retaining said plurality of contacts includes a plurality of access slots formed in said body, each of said slots terminating in a semicircular portion.

4. The molded connector described in claim 3, wherein said means for isolating said contact from each other includes a plurality of fins extending from said first surface, second surface and said perimeter surface, said fins constructed and arranged to create a barrier between the slots.

5. The molded connector described in claim 4, whereby said fins are constructed and arranged whereby, as heated material is injected around the contact support, the fins will melt and fuse with the heated material while the contact support remains solid.

6. The molded connector described in claim 5, whereby said fins have a thickness of between 0.013 and 0.023".

7. The molded connector described in claim 5, whereby a thickness ratio between the contact support and the fins is 7:1.

8. The molded connector described in claim 1, whereby said moldable material is a thermoplastic.

9. A heat moldable contact support for a molded electrical connector, said contact support constructed of a heat moldable material and comprising:

a substantially disk-shaped body having a front surface, rear surface and outer perimeter surface;

a plurality of access slots formed in said body, each of said slots terminating in a semicircular area and constructed and arranged to securely hold a cylindrical contact; and a plurality of fins extending from said first surface, second surface and said perimeter surface, said fins constructed and arranged to melt at a substantially lower temperature than said disk, thereby isolating said cylindrical contacts from each other.

10. A molded electrical connector for completing an electrical circuit, said connector comprising:

a head made of a moldable material;

a contact support made of a second moldable material having a chemical compatibility and melting point substantially the same as said moldable material, said contact support including means for retaining a plurality of contacts and means for isolating said contacts from each other; and a plurality of wires electrically and mechanically connected to said plurality of contacts.

* * * * *